US011469507B2

(12) United States Patent
Lee et al.

(10) Patent No.: US 11,469,507 B2
(45) Date of Patent: Oct. 11, 2022

(54) ANTENNA MODULE FOR SUPPORTING VERTICAL POLARIZATION RADIATION AND ELECTRONIC DEVICE INCLUDING SAME

(71) Applicants: SAMSUNG ELECTRONICS CO., LTD., Suwon-si (KR); POSTECH ACADEMY-INDUSTRY FOUNDATION, Pohang-si (KR)

(72) Inventors: Jung Yub Lee, Suwon-si (KR); Jun Ho Park, Pohang-si (KR); Doo Seok Choi, Pohang-si (KR); Won Bin Hong, Pohang-si (KR); Young Ju Lee, Suwon-si (KR)

(73) Assignees: SAMSUNG ELECTRONICS CO., LTD., Suwon-si (KR); POSTECH ACADEMY-INDUSTRY FOUNDATION, Pohang (KR)

( * ) Notice: Subject to any disclaimer, the term of this patent is extended or adjusted under 35 U.S.C. 154(b) by 225 days.

(21) Appl. No.: 16/954,771

(22) PCT Filed: Nov. 9, 2018

(86) PCT No.: PCT/KR2018/013627
§ 371 (c)(1),
(2) Date: Jun. 17, 2020

(87) PCT Pub. No.: WO2019/124737
PCT Pub. Date: Jun. 27, 2019

(65) Prior Publication Data

US 2021/0091473 A1 Mar. 25, 2021

(30) Foreign Application Priority Data

Dec. 19, 2017 (KR) ..... 10-2017-0175527

(51) Int. Cl.
*H01Q 1/24* (2006.01)
*H01Q 9/04* (2006.01)
*H01Q 5/371* (2015.01)

(52) U.S. Cl.
CPC ..... *H01Q 9/0414* (2013.01); *H01Q 1/243* (2013.01); *H01Q 5/371* (2015.01)

(58) Field of Classification Search
CPC ..... H01Q 9/0414; H01Q 5/371; H01Q 1/243
See application file for complete search history.

(56) References Cited

U.S. PATENT DOCUMENTS 9,559,428 B1 1/2017 Jensen et al.
2002/0003499 A1 1/2002 Kouam et al.
(Continued)

FOREIGN PATENT DOCUMENTS

CN 101022187 8/2007
EP 3 616 259 3/2020
(Continued)

OTHER PUBLICATIONS

International Search Report for PCT/KR2018/013627 dated Apr. 15, 2019, 4 pages.
(Continued)

*Primary Examiner* — Graham P Smith
(74) *Attorney, Agent, or Firm* — Nixon & Vanderhye, P.C.

(57) ABSTRACT

The present invention relates to a communication technique for fusing a 5G communication system to support a higher data transmission rate than a 4G system, with IoT technology, and a system thereof. In addition, the present invention provides an antenna module comprising: a first plate which forms an upper surface of the antenna module and has a first opening surface on one side surface, a second plate which forms a side surface of the antenna module, forms a first
(Continued)

angle with the first plate in contact with the first plate, and has a second opening surface on one side surface so as to extend the first opening surface, and a power supply unit which has one surface electrically connected to the first plate and is disposed on the first opening surface or the second opening surface.

7 Claims, 15 Drawing Sheets

(56) References Cited

U.S. PATENT DOCUMENTS

| | | | | |
|---|---|---|---|---|
| 2002/0021257 | A1 | 2/2002 | Zimmerman | |
| 2004/0056814 | A1 | 3/2004 | Park et al. | |
| 2011/0175783 | A1 | 7/2011 | Kim | |
| 2013/0222196 | A1 | 8/2013 | Hashimoto et al. | |
| 2014/0009355 | A1* | 1/2014 | Samardzija ..... | H01Q 9/0407 343/789 |
| 2014/0145879 | A1 | 5/2014 | Pan | |
| 2014/0247188 | A1 | 9/2014 | Nakano et al. | |
| 2015/0035714 | A1 | 2/2015 | Zhou | |
| 2015/0070228 | A1 | 3/2015 | Gu et al. | |
| 2015/0303587 | A1 | 10/2015 | Pan | |
| 2015/0380809 | A1* | 12/2015 | Uchida ..... | H01Q 7/00 343/700 MS |
| 2016/0079672 | A1 | 3/2016 | Cerreno | |
| 2017/0012364 | A1 | 1/2017 | Yang et al. | |
| 2017/0222326 | A1 | 8/2017 | Wight et al. | |
| 2020/0203804 | A1 | 6/2020 | Khripkov et al. | |

FOREIGN PATENT DOCUMENTS

| | | |
|---|---|---|
| JP | H09-199935 | 7/1997 |
| JP | 2003-283217 | 10/2003 |
| KR | 10-2006-0095372 | 8/2006 |
| KR | 10-2007-0056261 | 6/2007 |
| KR | 10-0922230 | 10/2009 |
| KR | 2010-200191 | 9/2010 |
| WO | 2018/206116 | 11/2018 |

OTHER PUBLICATIONS

Written Opinion of the ISA for PCT/KR2018/013627 dated Apr. 15, 2019, 5 pages.

Li et al., "A Multibeam End-Fire Magnetoelectric Dipole Antenna Array for Millimeter-Wave Applications", IEEE Transactions on Antennas and Propagation, vol. 64, No. 7, Apr. 15, 2016, pp. 2894-2904.

Kim et al., "A Study of Array Antenna with Phase Compensated Technique for 60 GHz Communication", IEEE Explore, Jun. 2, 2016, 4 pages.

Suga et al., "Cost-Effective 60-GHz Antenna Package with End-Fire Radiation for Wireless File-Transfer System", IEEE Transactions on Microwave Theory and Techniques, vol. 58, No. 12, Nov. 11, 2010, pp. 3989-3995.

Hong et al., "Grid Assembly-Free 60-GHz Antenna Module Embedded in FR-4 Transceiver Carrier Board", IEEE Transactions on Antennas and Propagation, vol. 61, No. 4, Dec. 11, 2012, pp. 1573-1580.

Hong et al., "mmWavePhased-Array with Hemispheric Coverage for 5$^{th}$ Generation Cellular Handsets", The 8$^{th}$ European Conference on Antennas and Propagation (EuCAP 2014), IEEE Xplore, Sep. 18, 2014, pp. 714-716.

Grzyb et al., "Wideband Cavity-backed Folded Dipole Superstrate Antenna for 60 GHz Applications", IEEE Transactions on Antennas and Propagation, Oct. 23, 2006, pp. 3939-3942.

Abdel-Wahab et al., "Wide-Bandwidth 60-GHz Aperture-Coupled Microstrip Patch Antennas (MPAs) Fed by Substrate Integrated Waveguide (SIW)", IEEE Antennas and Wireless Propagation Letters, vol. 10, Sep. 15, 2011, pp. 1003-1005.

Hsu et al., "A 60-GHz Millimeter-Wave CPW-Fed Yagi Antenna Fabricated by Using 0.18-μm CMOS Technology", IEEE Electron Device Letters, vol. 29, No. 6, May 20, 2008, pp. 625-627.

Extended Search Report dated Dec. 4, 2020 in counterpart European Patent Application No. 18893174.5.

* cited by examiner

ANTENNA MODULE FOR SUPPORTING VERTICAL POLARIZATION RADIATION AND ELECTRONIC DEVICE INCLUDING SAME

FIELD

This application is the U.S. national phase of International Application No. PCT/KR2018/013627 filed Nov. 9, 2018 which designated the U.S. and claims priority to KR Patent Application No. 10-2017-0175527 filed Dec. 19, 2017, the entire contents of each of which are hereby incorporated by reference.

The disclosure relates to an antenna module capable of radiating a vertically polarized wave and an electronic device including the same.

DESCRIPTION OF RELATED ART

In order to satisfy wireless data traffic demands that tend to increase after 4G communication system commercialization, efforts to develop an enhanced 5G communication system or a pre-5G communication system are being made. For this reason, the 5G communication system or pre-5G communication system is called a beyond 4G network communication system or a post LTE system. In order to achieve a high data transfer rate, the 5G communication system is considered to be implemented in a mmWave band (e.g., 60 GHz band). In order to reduce a propagation path loss and increase the transfer distance of electric waves in the mmWave band, beamforming, massive MIMO, full dimensional MIMO (FD-MIMO), array antenna, analog beam-forming and large scale antenna technologies are being discussed in the 5G communication system. Furthermore, in order to improve the network of a system, technologies, such as an improved small cell, an advanced small cell, a cloud radio access network (cloud RAN), an ultra-dense network, device to device communication (D2D), wireless backhaul, a moving network, cooperative communication, coordinated multi-points (CoMP) and reception interference cancellation, are being developed in the 5G communication system. In addition, hybrid FSK and QAM modulation (FQAM) and sliding window superposition coding (SWSC) that are advanced coding modulation (ACM) schemes, improved filter bank multi-carrier (FBMC), non-quadrature multiple access (NOMA) and sparse code multiple access (SCMA) are being developed in the 5G system.

The Internet evolves from a human-centered connection network over which human generates and consumes information to Internet of Things (IoT) through which information is exchanged and processed between distributed elements, such as things. An Internet of Everything (IoE) technology in which a big data processing technology through a connection with a cloud server is combined with the IoT technology is emerging. In order to implement the IoT, technical elements, such as the sensing technology, wired/wireless communication and network infrastructure, service interface technology and security technology, are required. Accordingly, technologies, such as a sensor network, machine to machine (M2M) and machine type communication (MTC) for a connection between things, are recently researched. In the IoT environment, an intelligent Internet technology (IT) service in which a new value is created for human life by collecting and analyzing data generated from connected things may be provided. The IoT may be applied to fields, such as a smart home, a smart building, a smart city, a smart car or a connected car, a smart grid, health care, smart home appliances, and advanced medical services, through convergence and composition between the existing information technology (IT) and various industries.

Accordingly, various attempts to apply the 5G communication system to the IoT are being made. For example, 5G communication technologies, such as a sensor network, machine to machine (M2M) and machine type communication (MTC), are implemented by schemes, such as beamforming, MIMO, and an array antenna. The application of a cloud wireless access network (cloud RAN) as the aforementioned big data processing technology may be said to be an example of convergence between the 5G technology and the IoT technology.

SUMMARY

As described above, in the 5G communication system, a propagation path loss is great. Accordingly, the structure of an antenna module using 5G communication is inevitably different from the antenna module structure of the 4G communication system.

A scheme taken into consideration in order to overcome the propagation path loss is the structure of an antenna module for generating a vertically polarized wave. In the 4G communication system, smooth communication can be performed between a terminal and a base station through only a horizontally polarized wave. In contrast, in the 5G communication system using an ultra-high frequency, smooth communication cannot be performed between a terminal and a base station through only a horizontally polarized wave.

Accordingly, the disclosure proposes an antenna module structure capable of generating a vertically polarized wave for solving the problem.

An embodiment of the disclosure provides an antenna module, including a first plate configuring the top side of the antenna module, a first aperture being formed in one side of the first plate, a second plate configuring the side of the antenna module and neighboring the first plate to form a first angle along with the first plate, a second aperture being formed in one side of the second plate so that the first aperture is extended, and a power feeding unit having one side electrically connected to the first plate and positioned in the first aperture or the second aperture.

The power feeding unit may include a first power feeding part formed along the first plate and a second power feeding part formed along the second plate. The first power feeding part and the second power feeding part form the first angle and may be electrically connected.

The antenna module may further include a first reflector spaced apart from the first power feeding part as much as a first distance and a second reflector spaced apart from the second power feeding part as much as a second distance.

The first angle may be 90°.

The widths of the first aperture and the second aperture may be identical. The widths of the first aperture and the second aperture may be determined based on a resonant frequency of the antenna module.

The first aperture and the second aperture may have a rectangle shape having an identical width. The edges of the first aperture and the second aperture may be subjected to tapering processing.

An embodiment of the disclosure provides an antenna module, including a multi-layered layer in which a plurality of layers is stacked, a slot being formed in one side of the multi-layered layer and a first power feeding part positioned in the slot.

The slot may be continuously extended and formed from the topmost layer of the one side of the multi-layered layer to one side of a preset layer.

The first power feeding part may be positioned along the outskirts of the multi-layered layer within the slot.

The antenna module may further include a reflector positioned within the multi-layered layer and spaced apart from the first power feeding part as much as a preset first distance.

The antenna module may further include a first ground pad positioned in the topmost layer of the multi-layered layer. The first power feeding part may be electrically connected to the first ground pad.

The slot may have a rectangle shape when viewed from the top side of the multi-layered layer. The length of each side of the rectangle may be determined based on a resonant frequency of the antenna module.

The edge of the slot may be subjected to tapering processing.

The antenna module may further include at least one patch antenna spaced apart from the one side of the multi-layered layer as much as a preset second distance and a second power feeding part electrically connected to the at least one patch antenna and positioned in the slot.

The antenna module may further include a second ground pad positioned in the topmost layer of the multi-layered layer. The second power feeding part may be electrically connected to the second ground pad.

The disclosure provides an electronic device including an antenna module. The antenna module has a plurality of layers stacked thereon, and includes a multi-layered layer in which a slot has been formed in one side thereof and a power feeding unit positioned in the slot. One side of the multi-layered layer may face the end of the electronic device.

The slot may be continuously extended and formed from the topmost layer of one side of the multi-layered layer to one side of a preset layer.

The power feeding unit may be positioned along the outskirts of the multi-layered layer within the slot.

The electronic device may further include a reflector positioned within the multi-layered layer and spaced apart from the power feeding unit by a preset distance and positioned.

The electronic device further includes a ground pad positioned in the topmost layer of the multi-layered layer. The power feeding unit may be electrically connected to the ground pad.

According to the disclosure, a vertically polarized wave can be generated through the antenna module. Particularly, a vertically polarized wave can be generated even in a structure by which it is difficult to generate a vertically polarized wave due to a narrow width, such as the end of a terminal.

DETAILED DESCRIPTION OF EXAMPLE EMBODIMENTS

Figure 1A:
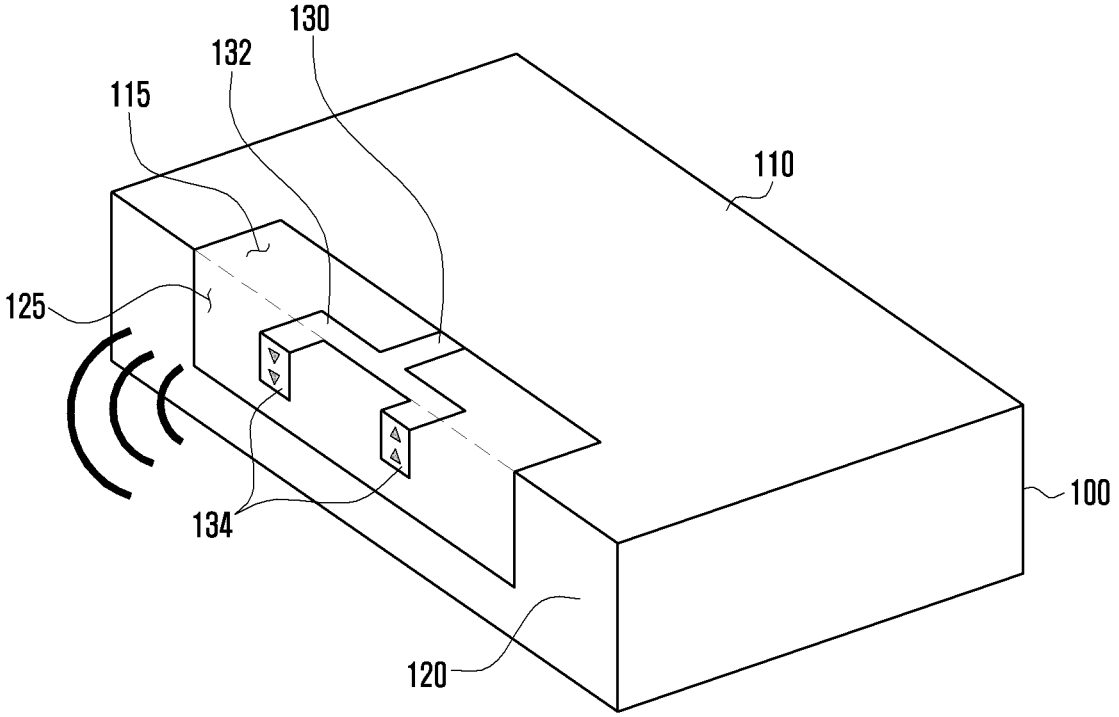
FIG. 1A illustrates an antenna module structure capable of generating a vertically polarized wave toward the end of an electronic device according to an embodiment of the disclosure.

In describing the embodiments, a description of contents that are well known in the art to which the disclosure pertains and not directly related to the disclosure is omitted in order to make the gist of the disclosure clearer.

For the same reason, in the accompanying drawings, some elements are enlarged, omitted or depicted schematically. Furthermore, the size of each element does not accurately reflect its real size. In the drawings, the same or similar elements are assigned the same reference numerals.

The merits and characteristics of the disclosure and a method for achieving the merits and characteristics will become more apparent from the embodiments described in detail in conjunction with the accompanying drawings. However, the disclosure is not limited to the disclosed embodiments, but may be implemented in various different ways. The embodiments are provided to only complete the disclosure of the disclosure and to allow those skilled in the art to understand the category of the disclosure. The disclosure is defined by the category of the claims. The same reference numerals will be used to refer to the same or similar elements throughout the drawings.

In this case, it will be understood that each of the blocks of the flowchart drawings and combinations of the blocks in the flowchart drawings can be executed by computer program instructions. These computer program instructions may be mounted on the processor of a general purpose computer, a special purpose computer or other programmable data processing apparatus, so that the instructions executed by the processor of the computer or other programmable data processing apparatus create means for executing the functions specified in the flowchart block(s). These computer program instructions may also be stored in computer-usable or computer-readable memory that can direct a computer or other programmable data processing equipment to function in a particular manner, such that the instructions stored in the computer-usable or computer-readable memory produce an article of manufacture including instruction means that implement the function specified in the flowchart block(s). The computer program instructions may also be loaded on a computer or other programmable data processing apparatus to cause a series of operational steps to be performed on the computer or other programmable apparatus to produce a computer-executed process, so that the instructions performing the computer or other programmable apparatus may provide steps for executing the functions described in the flowchart block(s).

Furthermore, each block of the flowchart drawings may represent a portion of a module, a segment or code, which includes one or more executable instructions for implementing a specified logical function(s). It should also be noted that in some alternative implementations, the functions noted in the blocks may be performed out of order. For example, two blocks shown in succession may in fact be executed substantially concurrently or the blocks may sometimes be executed in the reverse order, depending upon the functionality involved.

In this case, the term "unit", as used in the present embodiment means software or a hardware component, such as a field programmable gate array (FPGA) or an application-specific integrated circuit (ASIC), and the "unit" performs specific tasks. The "unit" may advantageously be configured to reside on an addressable storage medium and configured to operate on one or more processors. Accordingly, the "unit" may include, for example, components, such as software components, object-oriented software components, class components, and task components, processes, functions, attributes, procedures, sub-routines, segments of program code, drivers, firmware, microcode, circuitry, data, databases, data structures, tables, arrays, and variables. The functionalities provided in the components and "units" may be combined into fewer components and "units" or may be further separated into additional components and "units." Furthermore, the components and "units" may be implemented to operate on one or more CPUs within a device or a security multimedia card.

In general, a radio wave radiated through an antenna travels in the state in which an electric field and a magnetic field are orthogonal to each other. A radio wave whose electric field is vertical to the ground is called a vertically polarized wave. In contrast, a radio wave whose electric field is horizontal to the ground is called a horizontally polarized wave.

According to one embodiment, a vertical polarization antenna or horizontal polarization antenna may be formed through a patch antenna. For example, a vertical polarization antenna may be formed through a patch antenna vertical to the ground. A horizontal polarization antenna may be formed through a patch antenna horizontal to the ground.

Recently, an electronic device (including a smartphone and a terminal) tends to have its size gradually reduced. Particularly, the thickness of the electronic device continues to be reduced. Accordingly, a horizontal polarization antenna can be mounted on the electronic device, but a vertical polarization antenna cannot be mounted on the electronic device due to a low thickness.

For this reason, there is a need for an antenna structure capable of generating a vertically polarized wave in a structure on which it is difficult to mount a patch type vertical polarization antenna, such as the end of an electronic device. The disclosure is intended to provide an antenna structure for solving such a problem.

FIG. 1A illustrates an antenna module structure capable of generating a vertically polarized wave toward the end of an electronic device according to an embodiment of the disclosure.

An antenna module 100 according to an embodiment of the disclosure may include a first plate 110 configuring the top side of the antenna module and a second plate 120 configuring the side of the antenna module 100 and neighboring the first plate 110 to form a first angle along with the first plate 110. According to one embodiment, the first plate 110 may face the top side of an electronic device, and the second plate 120 may face the side of the electronic device.

A first aperture 115 may be formed in one side of the first plate. A second aperture 125 may be formed in one side of the second plate 120 so that the first aperture 115 extends.

According to one embodiment, an opening part having a given shape (rectangular parallelepiped shape in FIG. 1A) may be formed in the antenna module 100 by the first aperture 115 and the second aperture 125.

According to one embodiment, a power feeding unit 130 is electrically connected to the first plate 110 and may be exposed to the outside through the first aperture 115 and the second aperture 125. The power feeding unit 130 may be electrically connected to a communication circuit (not illustrated). The power feeding unit 130 may receive an electric current from the communication circuit and radiate a radio wave having a given frequency.

According to one embodiment, the power feeding unit 130 may include a first power feeding part 132 formed in parallel to the first plate and a second power feeding part 134 formed in parallel to the second plate. The first power feeding part 132 and the second power feeding part 134 may be electrically connected by forming the first angle. According to one embodiment, the first power feeding part 132 and the second power feeding part 134 may be formed at an angle of 90°.

According to one embodiment, a radio wave may be selectively radiated in the direction of the first plate 110 or in the direction of the second plate 120 by controlling an electric current flowing into the first power feeding part 132 or the second power feeding part 134.

For example, as disclosed in FIG. 1A, if only an electric current flowing into the second power feeding part 134 is excited, a radio wave may be radiated only in the direction of the second plate 120. Furthermore, in this case, the radio wave radiated in the direction of the second plate 120 may be a vertically polarized wave. A vertically polarized wave may be generated through a structure, such as that illustrated in FIG. 1A. This is described later with reference to FIGS. 5 and 6.

According to one embodiment, an opening part may be formed by removing the plating of a first face corresponding to the first aperture and a second face corresponding to the second aperture in a plated antenna module structure.

According to one embodiment, a current vector having a given shape is formed in the opening part by applying an electric current to the power feeding unit 130 positioned in the opening part. Accordingly, an electric field vertical to the ground may be formed.

Figure 1B:
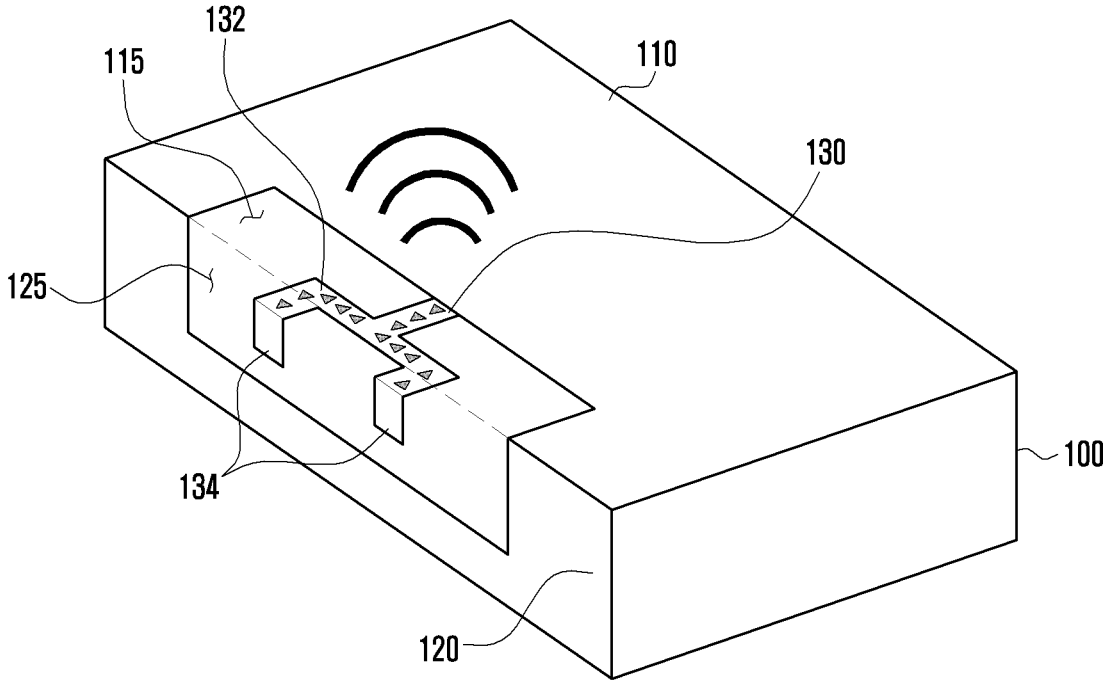
FIG. 1B illustrates an antenna module structure capable of generating a vertically polarized wave toward the top side of an electronic device according to an embodiment of the disclosure.

FIG. 1B illustrates an antenna module structure capable of generating a vertically polarized wave toward the top side of an electronic device according to an embodiment of the disclosure.

The antenna module structure illustrated in FIG. 1B is the same as that illustrated in FIG. 1A. In this case, in FIG. 1B, a communication circuit may excite only an electric current flowing into the first power feeding part 132. Accordingly, the antenna module 100 may radiate a radio wave only in the direction of the first plate 110.

The remaining antenna module elements disclosed in FIG. 1B may be the same or similar to the remaining antenna module elements disclosed in FIG. 1A.

Figure 2:
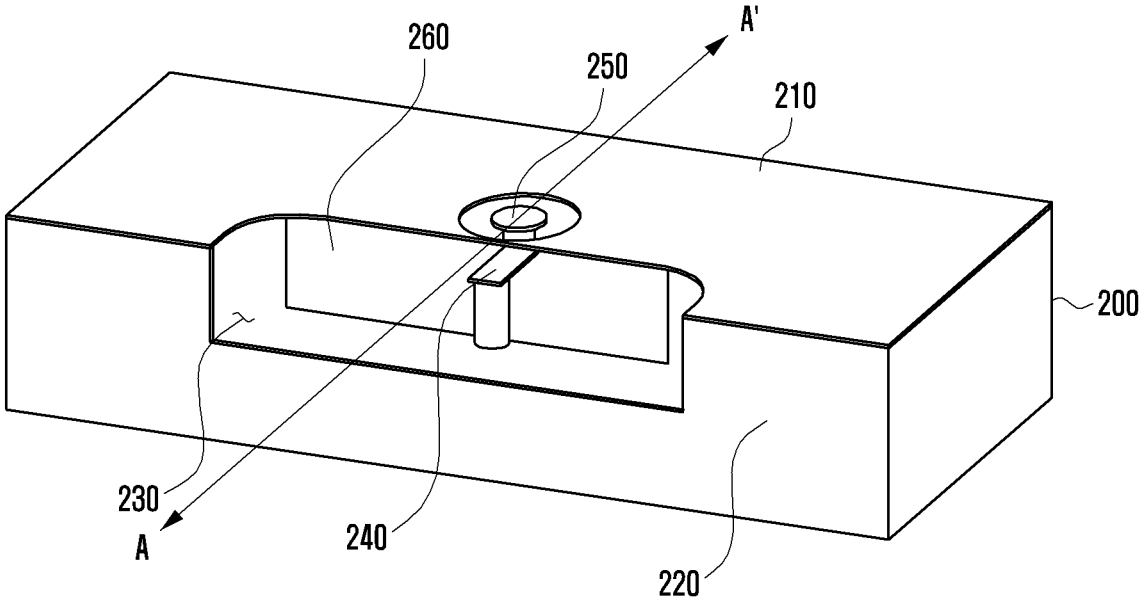
FIG. 2 illustrates an antenna module structure capable of generating a vertically polarized wave according to an embodiment of the disclosure.

FIG. 2 illustrates an antenna module structure capable of generating a vertically polarized wave according to an embodiment of the disclosure.

An antenna module 200 according to the disclosure may have a structure in which a plurality of layers has been stacked. For example, the antenna module may be a printed circuit board (PCB) in which a plurality of insulation layers has been stacked. A slot 230 may be formed in one side 220 of the multi-layered layer 200 in which the plurality of layers has been stacked.

The slot 230 may be formed only in some of the plurality of layers. For example, the slot may be continuously extended and formed from one side 220 of the topmost layer 210 of the multi-layered layer 200 to one side of a preset layer.

According to one embodiment, a slot having the same shape may be formed in one side 220 up to the third layer downward from the topmost layer 210 of the multi-layered layer 200. The slot may not be formed from the fourth layer to the lowest layer downward from the topmost layer 210.

According to one embodiment, a power feeding unit 240 may be positioned in the slot 230. The power feeding unit 240 may be positioned along the outskirts of the multi-layered layer 200. A more detailed shape of the power feeding unit 240 is described later through a description of FIG. 3.

When an electric current is applied to the power feeding unit 240, the vectors of the electric current (J surface current) are distributed along the slot 230 that surrounds the power feeding unit 230, so a vertically polarized wave may be radiated in the direction of one side 220 of the multi-layered layer 200. Accordingly, the frequency characteristic of a radio wave radiated through the antenna module including the multi-layered layer 200 may be determined based on the size and shape of the slot 230. This is described later through a description of FIG. 4.

According to one embodiment, a reflector 260 positioned within the multi-layered layer 200 and spaced apart from the power feeding unit 240 by a preset distance may be further included. The reflector 260 can improve a gain value of the antenna module by reflecting a radio wave, radiated toward the inside of the multi-layered layer 200, toward the outside of one side 220 of the multi-layered layer 200.

According to one embodiment, the reflector 260 may have various shapes. Furthermore, the distance between the reflector 260 and the power feeding unit 240 that radiates a radio wave may be determined based on a frequency that is to be radiated through the power feeding unit 240.

According to one embodiment, a ground pad 250 may be positioned in the topmost layer 210 of the multi-layered layer 200. For example, mounting between the multi-layered layer 200 and a communication circuit may be facilitated by positioning, in the topmost layer 210, a ground signal ground (GSG) pad using a coaxial method. According to one embodiment, the power feeding unit 240 may be electrically connected to the ground pad 250.

The antenna module structure disclosed in FIG. 2 is merely an embodiment, and thus the scope of the disclosure should not be limited to the antenna module structure disclosed in FIG. 2. For example, two or more power feeding units 240 may be disposed in the slot 230.

Figure 3:
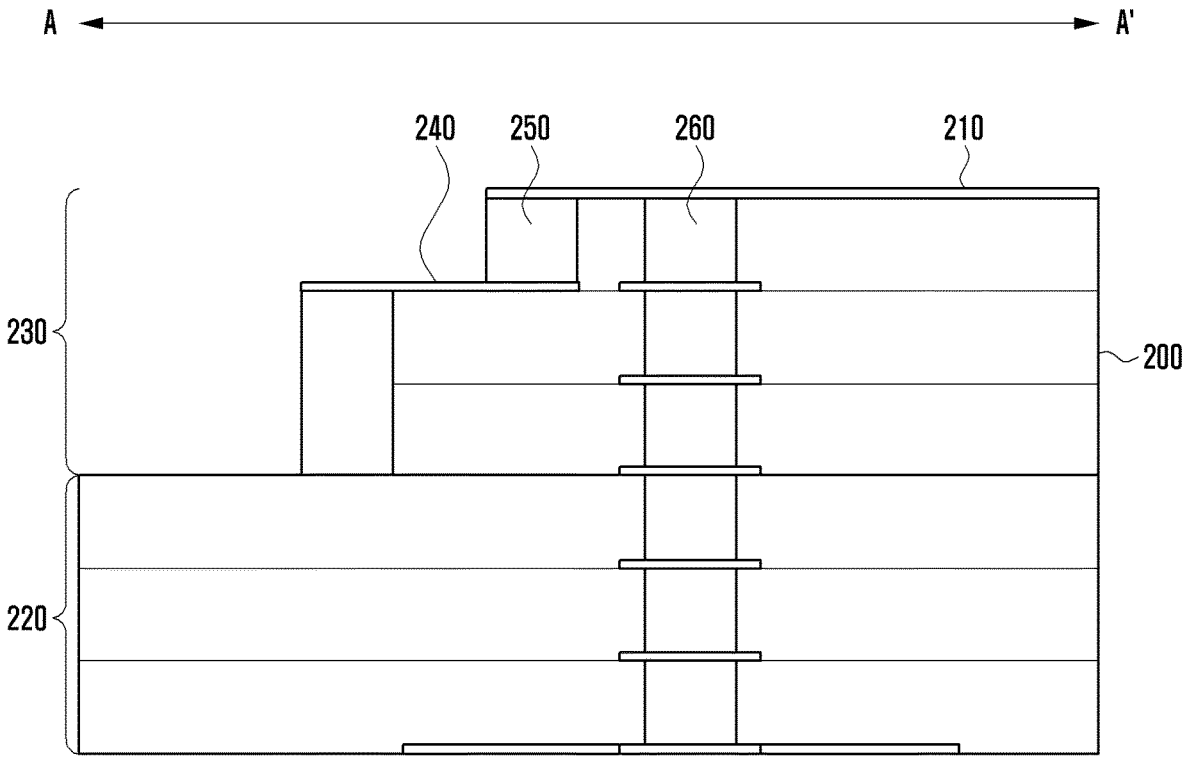
FIG. 3 is a diagram illustrating a side view of the antenna module structure illustrated in FIG. 2, which is taken in a direction AA'.

FIG. 3 is a diagram illustrating a side view of the antenna module structure illustrated in FIG. 2, which is taken in a direction AA'.

FIG. 3 is a diagram illustrating a case where the multi-layered layer 200 is configured with 7 layers. The slot may be formed up to the third layer downward from the topmost layer 210 of the multi-layered layer 200. In contrast, the slot 230 may not be formed from the fourth layer to the sixth layer downward from the topmost layer 210. That is, the multi-layered layer 200 according to the disclosure may be divided into a layer area 230 in which the slot is formed and a layer area 220 in which the slot is not formed.

According to one embodiment, the power feeding unit 240 may be positioned in the layer area 230 in which the slot is formed. The power feeding unit 240 may be electrically connected to a ground pad 250, positioned in the topmost layer 210, in the first layer downward from the topmost layer 210.

Furthermore, the power feeding unit 240 may be extended toward one side of the multi-layered layer 200 in which the slot has been formed in the first layer downward from the topmost layer 210, thus forming a first power feeding part. The power feeding unit 240 may be bent by 90° at the end of the first power feeding part and may be extended up to the third layer downward from the topmost layer 210, thus forming a second power feeding part (the power feeding unit 240 is described as being divided into the first power feeding part and the second power feeding part, but the first power feeding part and the second power feeding part may be one element). According to one embodiment, impedance matching of the antenna module may be implemented based on the length of the power feeding unit 240.

The antenna module structure disclosed in FIG. 3 and the antenna module structure disclosed in FIGS. 1A and 1B may be associated. For example, if an electric current is excited in the second power feeding part extended from the first layer to the third layer downward from the topmost layer 210 in FIG. 3, this may lead to the antenna module radiation structure disclosed in FIG. 1A. If an electric current is excited in the first power feeding part, this may lead to the antenna module radiation structure disclosed in FIG. 1B.

The reflector 260 may be spaced apart from the power feeding unit 240 by a preset distance and positioned. A radio wave radiated from the power feeding unit 240 toward the radiator 260 may be reflected by the reflector 260. A radio wave reflected by the reflector 260 may be radiated to the outside of the antenna module through the layer area 230 in which the slot has been formed. According to one embodiment, the layer area 220 in which the slot has not been formed may be configured as a ground layer.

Figure 4:
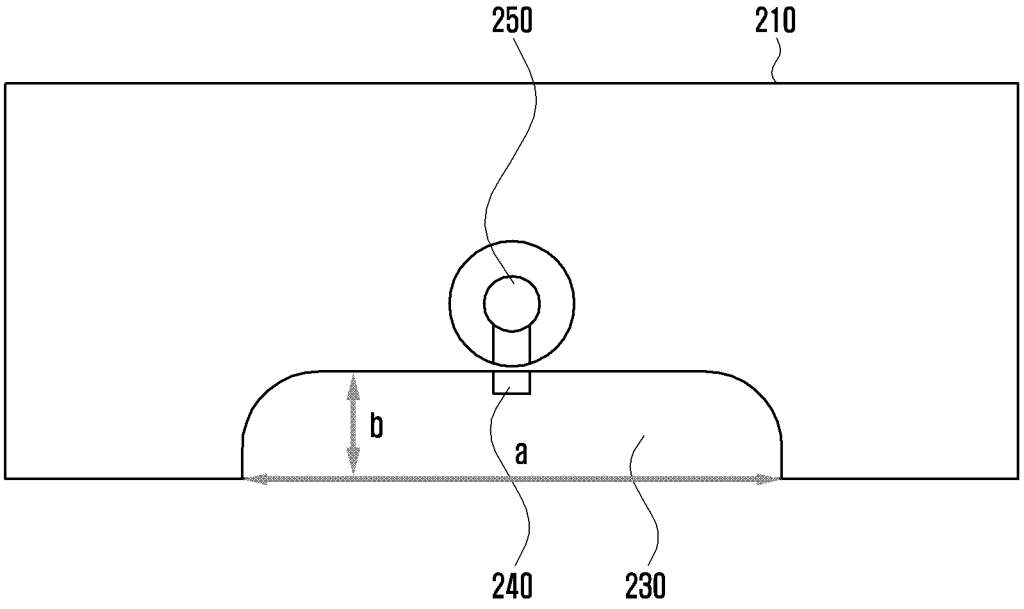
FIG. 4 is a diagram illustrating the state in which the antenna module structure illustrated in FIG. 2 has been viewed from the top.

FIG. 4 is a diagram illustrating the state in which the antenna module structure illustrated in FIG. 2 has been viewed from the top.

The slot 230 may be formed in one side of the topmost layer 210. The slot 230 may have a rectangle shape having a base "a" and a height "b." According to one embodiment, edges on both sides of the rectangle shape may have rounds through tapering processing in order to minimize the internal reflection of a radio wave.

As disclosed above, the frequency characteristic of a radio wave radiated through the slot 230 may be determined based on the size of the slot 230. For example, the value "a" may be determined based on a resonant frequency value of the antenna module. The value "b" may be determined based on an impedance bandwidth of the antenna module. According to one embodiment, the value "a" may be greater than the value "b."

According to one embodiment, the ground pad 250 may be positioned in the topmost layer 210. The ground pad 250 may be positioned in a hole formed in the topmost layer 210. FIG. 4 illustrates a case where the ground pad 250 and the hole have been formed in a circle shape, but the scope of the disclosure should not be limited thereto. The ground pad 250 and the hole may have various shapes.

Figure 5:
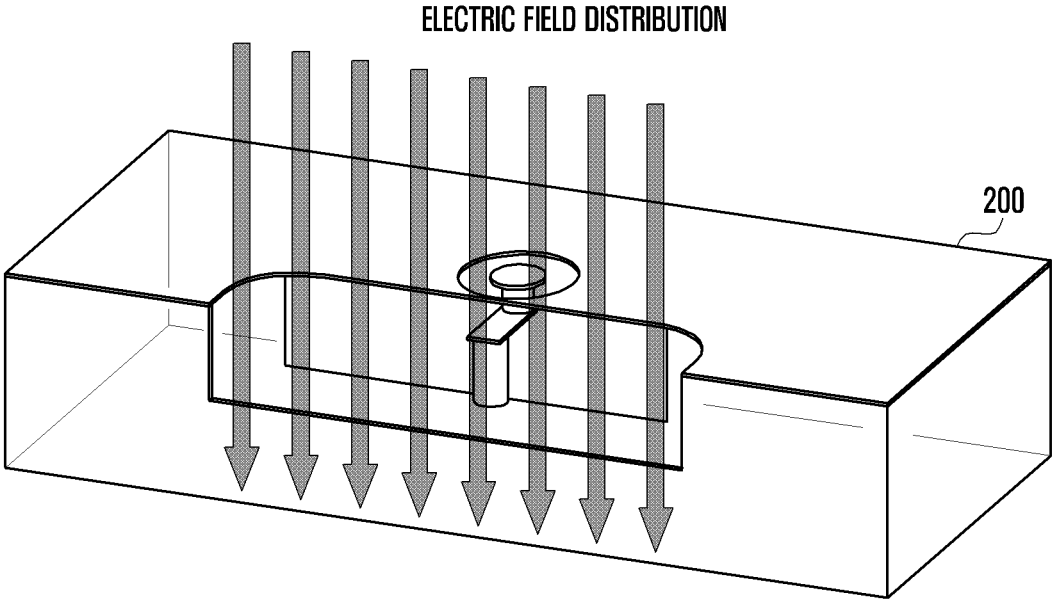
FIG. 5 is a diagram illustrating an electric field distribution of the antenna module structure disclosed in FIGS. 2 to 4.

FIG. 5 is a diagram illustrating an electric field distribution of the antenna module structure disclosed in FIGS. 2 to 4.

According to the antenna module structure disclosed in the disclosure, an electric field vertical to the ground may be formed. Accordingly, a vertically polarized wave may be radiated. An antenna module according to an embodiment of the disclosure can generate a vertically polarized wave even without a patch antenna vertical to the ground. Accordingly, the antenna module according to an embodiment of the disclosure can efficiently generate a vertically polarized wave although a space is narrow as in the end of an electronic device.

Figure 6:
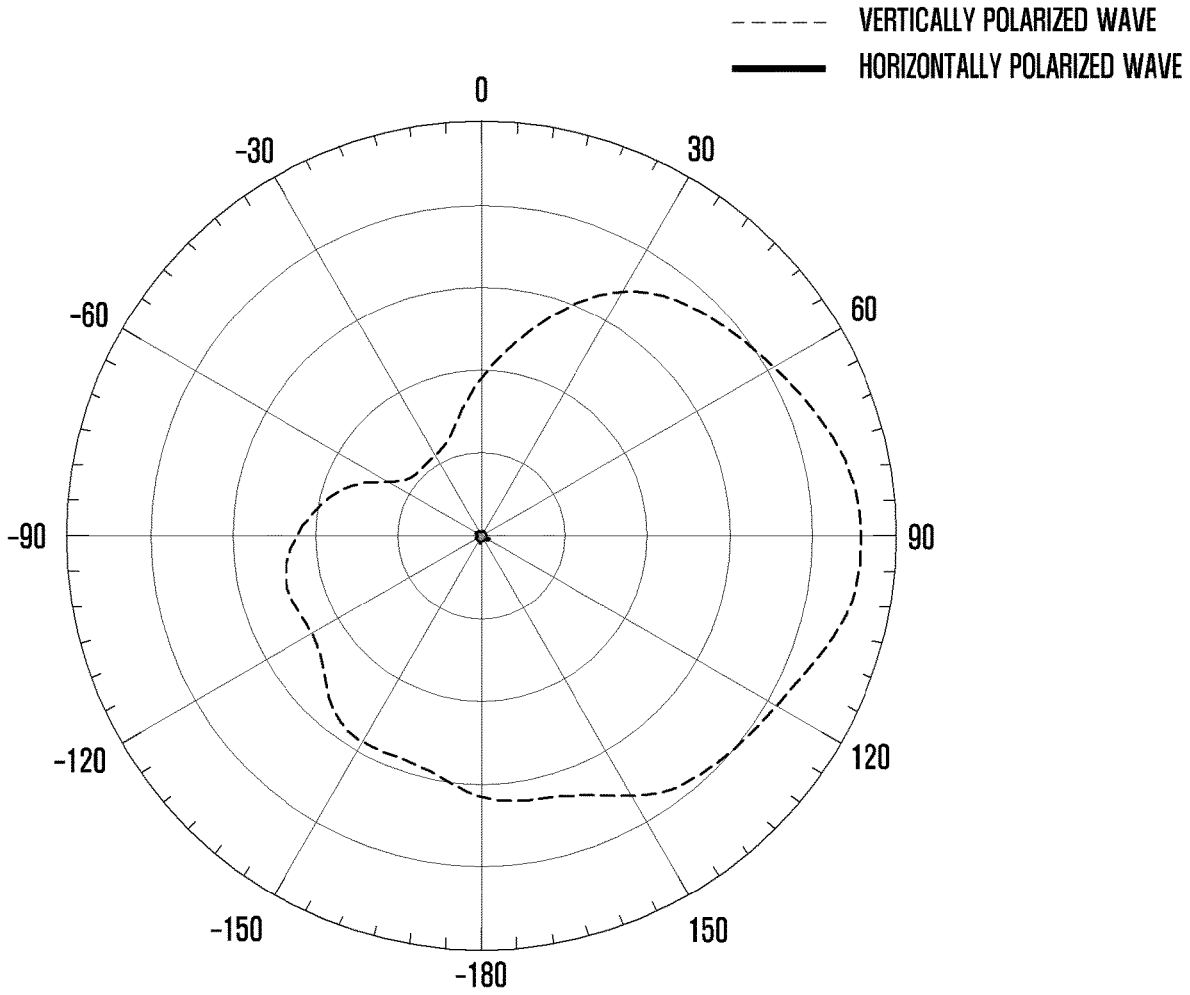
FIG. 6 is a graph illustrating the characteristics of the electric field distribution disclosed in FIG. 5.

FIG. 6 is a graph illustrating the characteristics of the electric field distribution disclosed in FIG. 5.

It may be seen that the antenna module structure disclosed in FIGS. 2 to 4 is an antenna module structure for generating a vertically polarized wave because a vertically polarized wave has a greater gain value than a horizontally polarized wave as disclosed in FIG. 6. Furthermore, it may be seen that the vertically polarized wave has about 10 dB a greater gain value than the horizontally polarized wave even at the end of the antenna module (or the end of an electronic device, a direction whose phase is 90° in FIG. 6).

Figure 7:
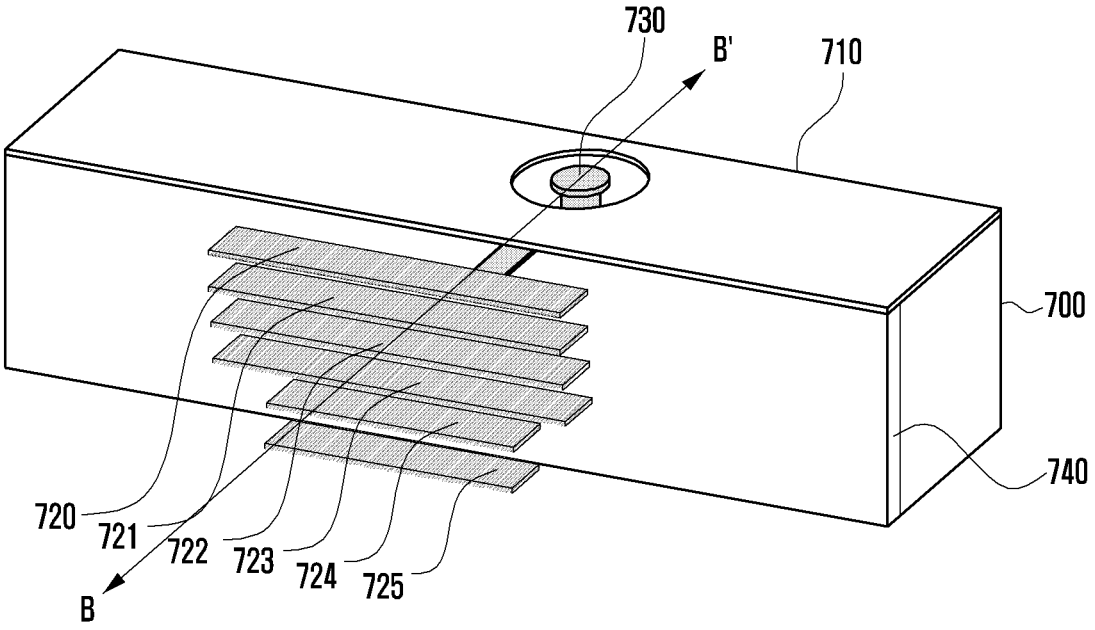
FIG. 7 illustrates an antenna module structure capable of generating a horizontally polarized wave according to an embodiment of the disclosure.

FIG. 7 illustrates an antenna module structure capable of generating a horizontally polarized wave according to an embodiment of the disclosure.

As disclosed in FIG. 7, a horizontally polarized wave may be generated by disposing a plurality of patch antennas 720, 721, 722, 723, 724, and 725 in respective layers configuring a multi-layered layer 700.

A slot antenna has been used in a vertically polarized wave as described above because it is impossible to dispose patch antennas in the direction vertical to the multi-layered layer 700. However, a horizontally polarized wave may be generated using the plurality of patch antennas 720, 721, 722, 723, 724, and 725 because the patch antennas can be disposed in the direction horizontal to the multi-layered layer 700.

According to one embodiment, the plurality of patch antennas 720, 721, 722, 723, 724, and 725 may be spaced apart from one side 740 of the multi-layered layer 700 by a preset distance and positioned. Furthermore, the plurality of patch antennas 720, 721, 722, 723, 724, and 725 may be interconnected through a via. According to one embodiment, the plurality of patch antennas 720, 721, 722, 723, 724, and 725 may be electrically connected to a ground pad 730 positioned in the topmost layer 710 of the multi-layered layer 700 through a power feeding unit 750.

The ground pad 730 may be a ground signal ground (GSG) pad using a coaxial method, and may facilitate mounting between the multi-layered layer 700 and a communication circuit (not illustrated) that applies an electric current to the power feeding unit 750.

Figure 8:
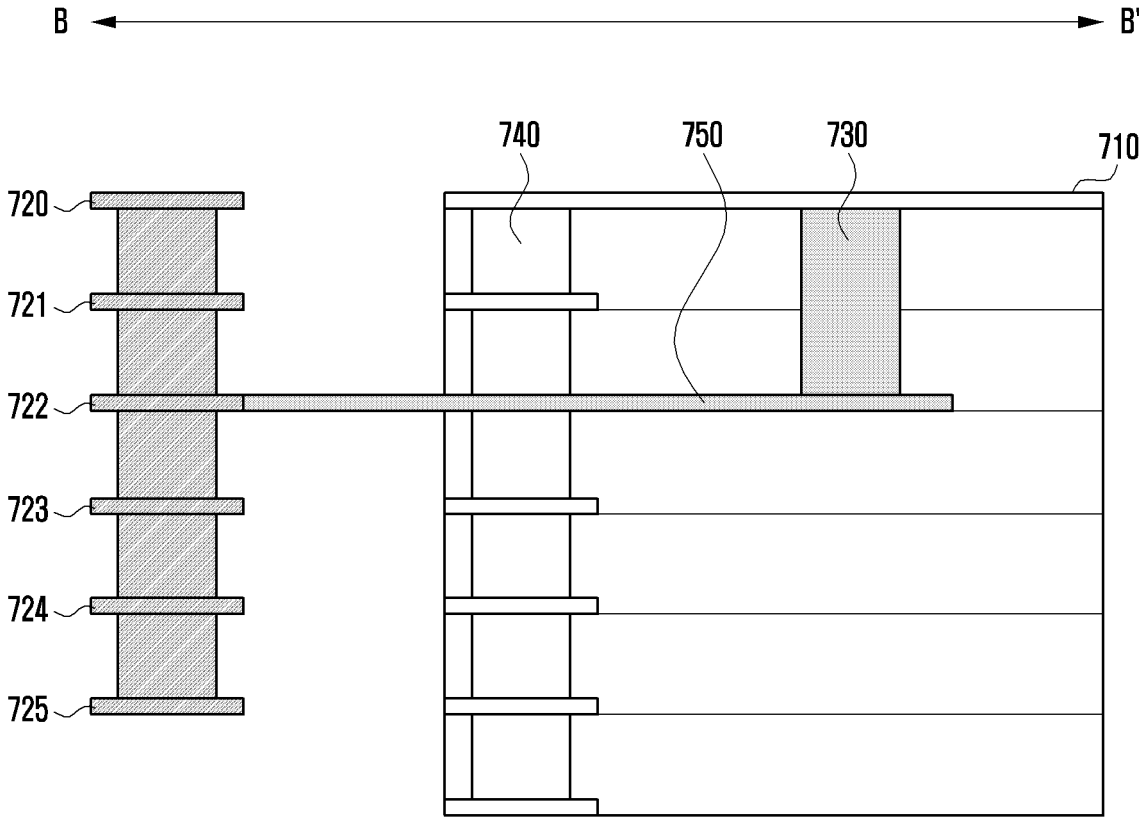
FIG. 8 is a diagram illustrating a side view of the antenna module structure illustrated in FIG. 7, which is taken in a direction BB'.

FIG. 8 is a diagram illustrating a side view of the antenna module structure illustrated in FIG. 7, which is taken in a direction BB'.

FIG. 8 is a diagram illustrating a case where the multi-layered layer 700 is configured with 7 layers. The ground pad 730 may be positioned in the topmost layer 710 of the multi-layered layer 700. The power feeding unit 750 may be electrically connected to a ground pad 730.

According to one embodiment, the plurality of patch antennas 720, 721, 722, 723, 724, and 725 may be spaced apart from one side 740 of the multi-layered layer 700 by a preset distance and positioned. According to one embodiment, the plurality of patch antennas 720, 721, 722, 723, 724, and 725 may be positioned in parallel to the respective layers of the multi-layered layer 700, and may be interconnected through a via.

Figure 9:
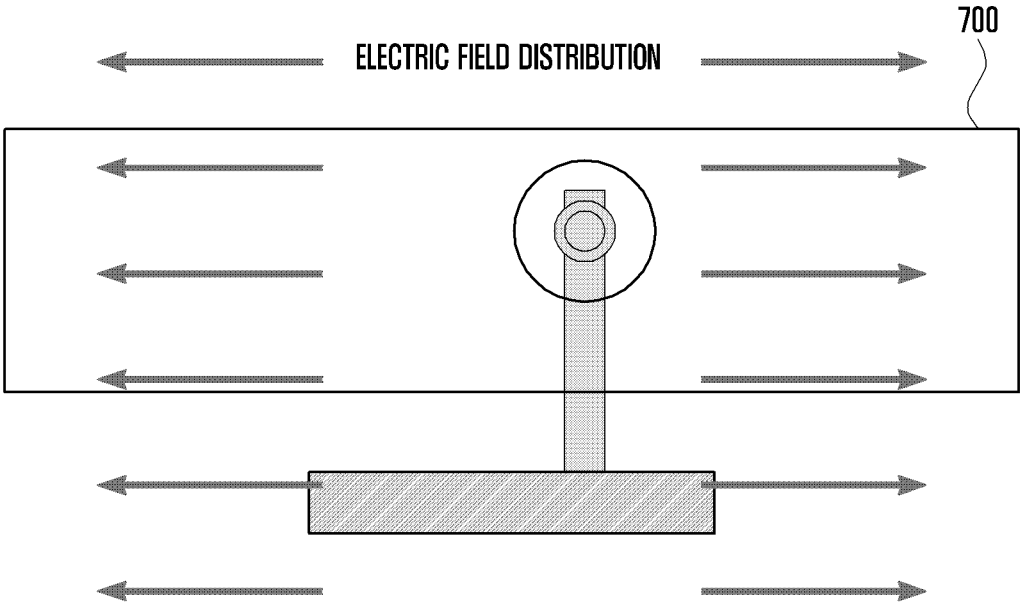
FIG. 9 is a diagram illustrating an electric field distribution of the antenna module structure disclosed in FIGS. 7 and 8.
Figure 10:
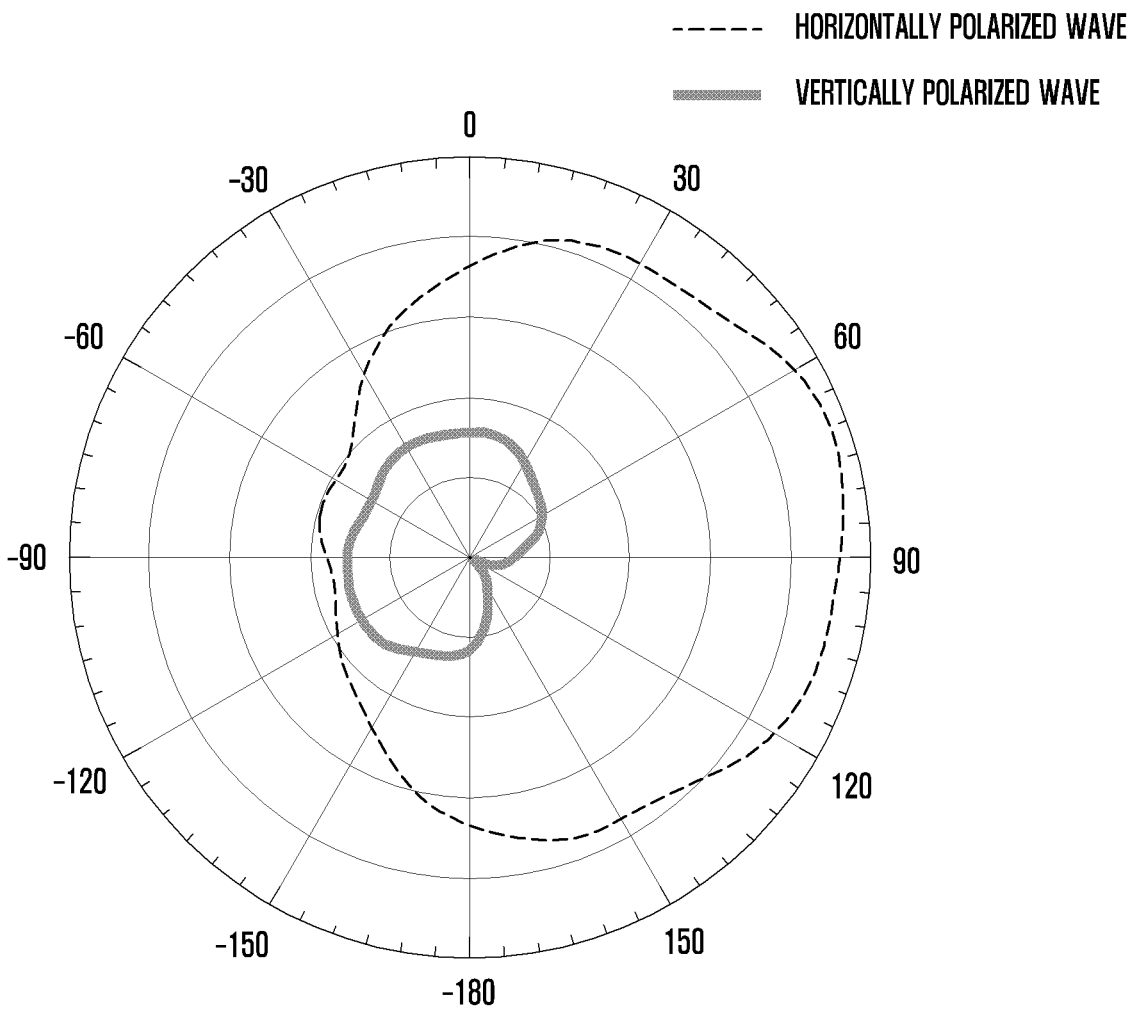
FIG. 10 is a diagram illustrating the characteristics of electric field distributions of the antenna module structure disclosed in FIGS. 7 and 8.

FIGS. 9 and 10 are diagrams illustrating electric field distributions and characteristics of the antenna module structure disclosed in FIGS. 7 and 8.

According to the antenna module structure disclosed in the disclosure, as disclosed in FIG. 9, an electric field horizontal to the ground may be formed. Accordingly, a horizontally polarized wave can be radiated.

Furthermore, as disclosed in FIG. 10, it may be seen that the antenna module structure disclosed in FIGS. 7 and 8 is an antenna module structure for generating a horizontally polarized wave because a horizontally polarized wave has a greater gain value than a vertically polarized wave. Furthermore, it may be seen that the horizontally polarized wave has about 10 dB a greater gain value than the vertically polarized wave even at the end of the antenna module (or the end of an electronic device).

Figure 11:
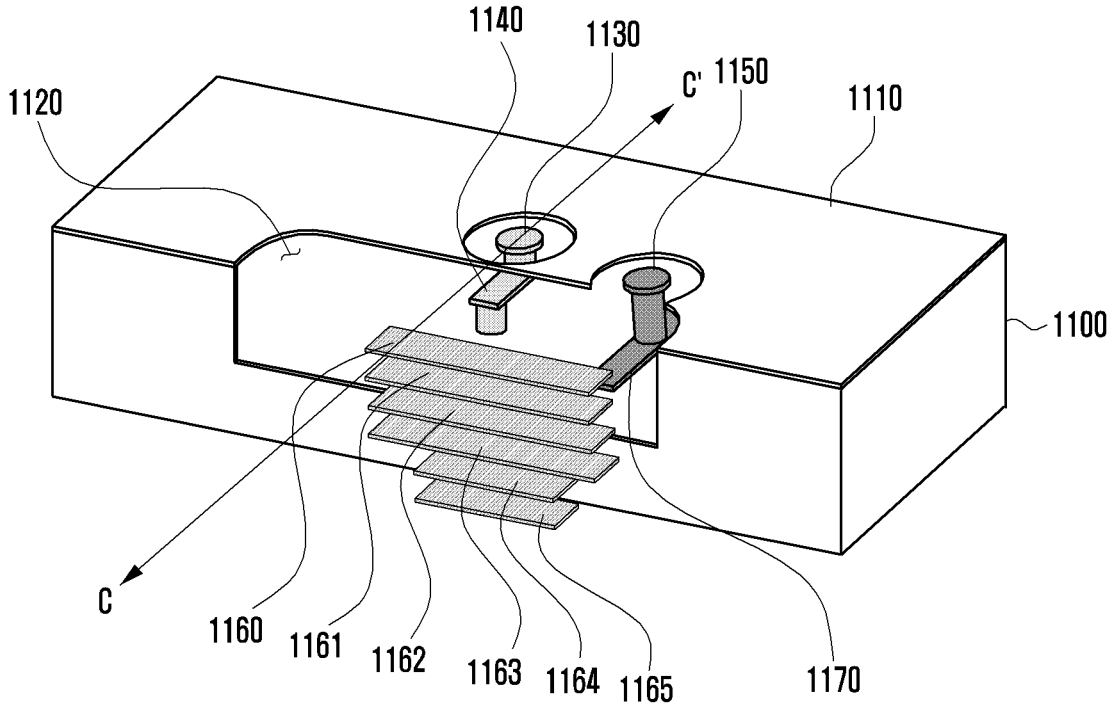
FIG. 11 illustrates an antenna module structure capable of generating both a vertically polarized wave and a horizontally polarized wave according to an embodiment of the disclosure.

FIG. 11 illustrates an antenna module structure capable of generating both a vertically polarized wave and a horizontally polarized wave according to an embodiment of the disclosure.

The antenna module structure illustrated in FIG. 11 may be configured by combining the vertical polarization antenna module illustrated in FIG. 2 and the horizontal polarization antenna module illustrated in FIG. 7.

According to one embodiment, at least one patch antenna 1160, 1161, 1162, 1163, 1164, and 1165 that radiates a horizontally polarized wave may be spaced apart from one side of a multi-layered layer 1100 by a preset distance and positioned. The at least one patch antenna 1160, 1161, 1162, 1163, 1164, and 1165 may be electrically connected to a second ground pad 1150 through a second power feeding part 1170.

According to one embodiment, the at least one patch antenna 1160, 1161, 1162, 1163, 1164, and 1165 may receive an electric current through the second power feeding part 1170 and form an electric field horizontal to the ground. Accordingly, a horizontally polarized wave can be generated.

According to one embodiment, a slot 1120 may be formed in one side of the multi-layered layer 1100. The slot 1120 may be extended from one side of the topmost layer 1110 of the multi-layered layer 1100 to one side of a preset layer.

According to one embodiment, a first power feeding part 1140 may be positioned in the slot 1120. The first power feeding part 1140 may be electrically connected to a first ground pad 1130 positioned in the topmost layer 1130 of the multi-layered layer 1100.

According to one embodiment, when an electric current is applied to the first power feeding part 1140, an current vector is formed along the outskirts of the slot. Accordingly, an electric field vertical to the ground is formed, so a vertically polarized wave can be generated.

Figure 12:
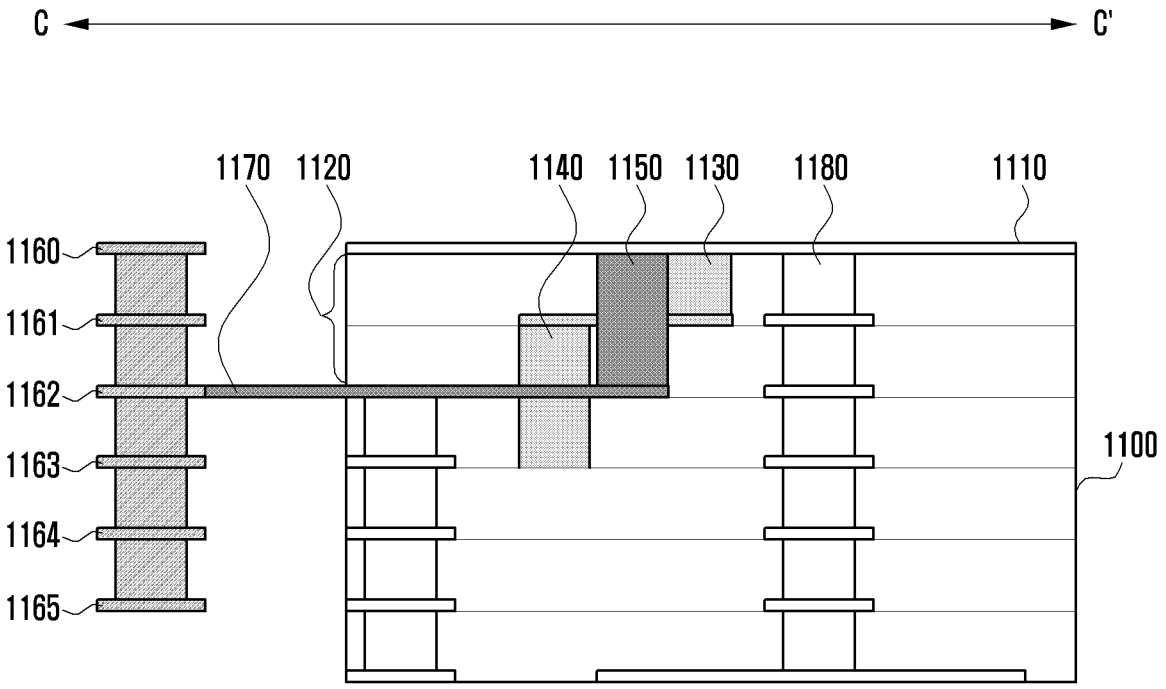
FIG. 12 is a diagram illustrating a side view of the antenna module structure, illustrated in FIG. 11, taken in a direction CC'.

FIG. 12 is a diagram illustrating a side view of the antenna module structure illustrated in FIG. 11, which is taken in a direction CC'.

FIG. 12 is a diagram illustrating a case where the multi-layered layer 1100 is configured with 7 layers. The first ground pad 1130 and the second ground pad 1150 may be positioned in the topmost layer 1110 of the multi-layered layer 1100. The first ground pad 1130 may be electrically connected to the first power feeding part 1140. The second ground pad 1150 may be electrically connected to the second power feeding part 1170.

The first power feeding part 1140 may be positioned in the slot 1120 formed in one side of the multi-layered layer 1100. According to one embodiment, the slot 1120 may be formed up to the third layer downward from the topmost layer 1110 of the multi-layered layer 1100.

According to one embodiment, the at least one patch antenna 1160, 1161, 1162, 1163, 1164, and 1165 may be spaced apart from one side of the multi-layered layer 1100 by a preset distance and positioned. The one side may be a face in which the slot 1120 is formed in the multi-layered layer 1100.

According to one embodiment, a reflector 1180 may be further included within the multi-layered layer 1100. The reflector 1180 may be spaced apart from the first power feeding part 1140 by a preset distance and positioned. Accordingly, a vertically polarized wave radiated toward the inside of the multi-layered layer 1100 may be reflected by the reflector 1180 and radiated to the outside of the multi-layered layer 1100.

Figure 13:
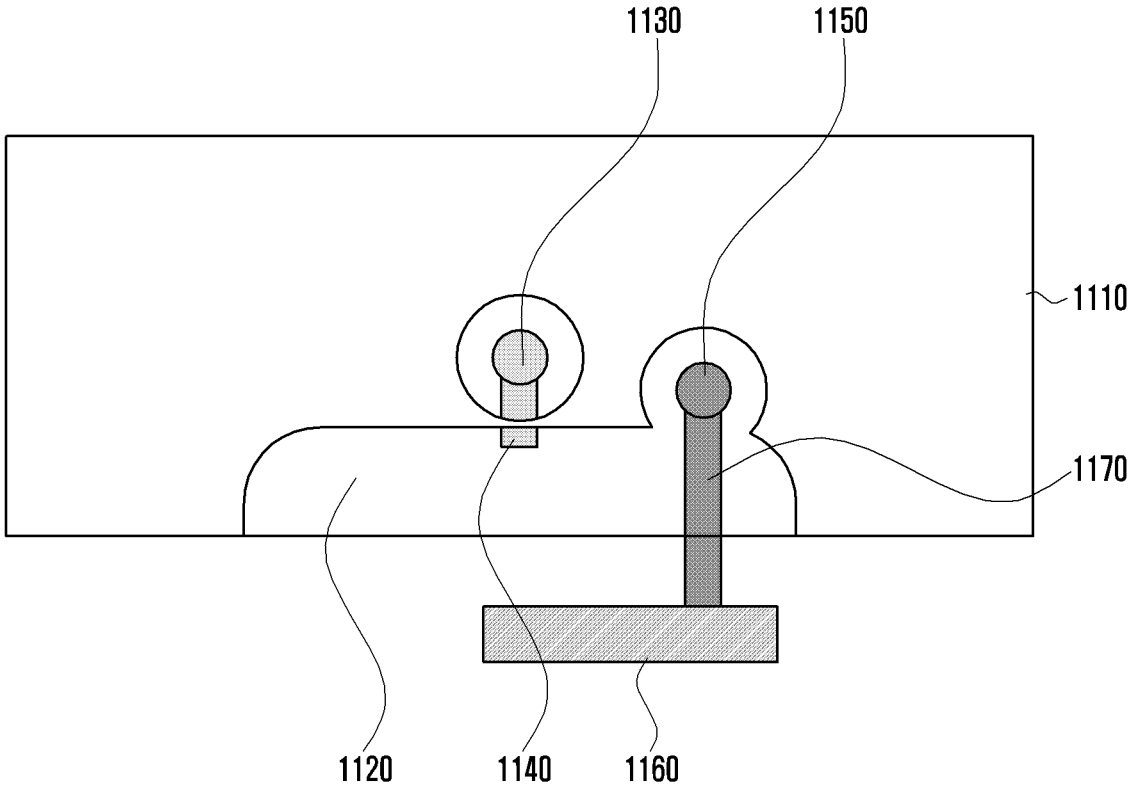
FIG. 13 is a diagram illustrating the state in which the antenna module structure illustrated in FIG. 11 is viewed from the top.

FIG. 13 is a diagram illustrating the state in which the antenna module structure illustrated in FIG. 11 is viewed from the top.

According to one embodiment, the slot 1120 may be formed in one side of the topmost layer 1110. The slot 1120 may have a rectangle shape. According to one embodiment, edges on both sides of the rectangle shape may have rounds through tapering processing in order to minimize the internal reflection of a radio wave.

According to one embodiment, the rectangle shape may be determined based on a resonant frequency value of the antenna module or an impedance bandwidth of the antenna module.

According to one embodiment, as disclosed above, a frequency characteristic of a radio wave radiated through the slot 230 may be determined based on the size of the slot 230. For example, the value "a" may be determined based on a resonant frequency value of the antenna module. The value "b" may be determined based on an impedance bandwidth of the antenna module.

According to one embodiment, the first ground pad 1130 and the second ground pad 1150 may be positioned in the topmost layer 1110. The first ground pad 1130 and the second ground pad 1150 may be positioned in respective holes formed in the topmost layer 1110. FIG. 13 illustrates a case where each of the first ground pad 1130, the second ground pad 1150, and each hole corresponding to each ground pad has been formed in a circle shape, but the scope of the disclosure should not be limited thereto.

The first ground pad 1130 may be electrically connected to the first power feeding part 1140 capable of generating a vertically polarized wave. The second ground pad 1150 may be electrically connected to the patch antenna 1160 capable of generating a horizontally polarized wave.

According to one embodiment, the patch antenna 1160 may be spaced apart from one side in which the slot 1120 is formed by a preset distance in the topmost layer 1110, and may be positioned.

Figure 14:
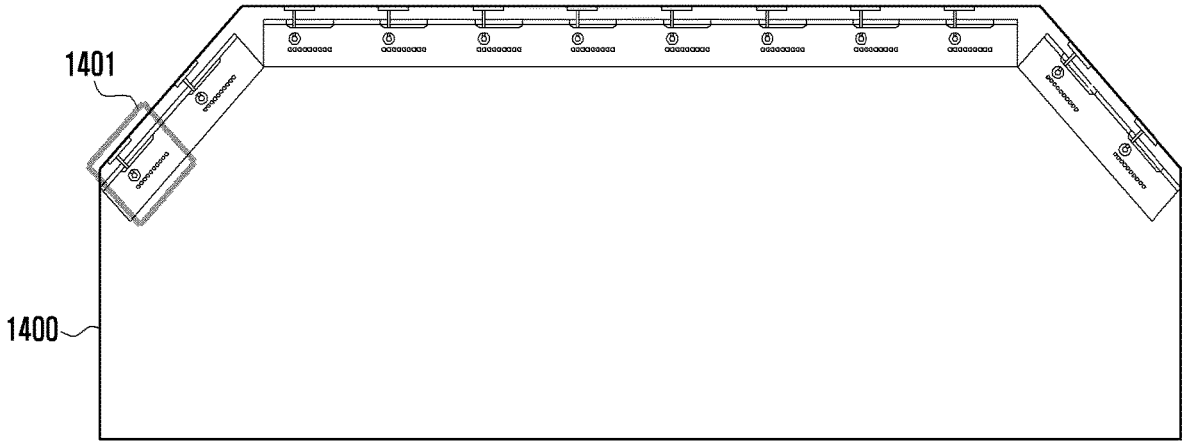
FIG. 14 is a diagram illustrating the state in which an antenna module according to an embodiment of the disclosure has been positioned in an electronic device.

FIG. 14 is a diagram illustrating the state in which an antenna module according to an embodiment of the disclosure has been positioned in an electronic device.

According to one embodiment, an antenna module 1401 may be positioned at the end of an electronic device 1400. More specifically, one side in which a slot and patch antenna are formed in the antenna module 1401 may face the end of the electronic device 1400.

According to one embodiment, the electronic device 1400 can generate a vertically polarized wave through the slot positioned at the end thereof, and can generate a horizontally polarized wave through the patch antenna.

According to one embodiment, a plurality of the antenna modules 1401 may be positioned at the end of the electronic device 1400. The plurality of antenna module may be positioned at the end of the electronic device 1400 in an array form.

The antenna module 1401 according to the disclosure may be suitable for an electronic device having a low height because it has a flat shape having a low height. Furthermore, the antenna module 1401 according to the disclosure may be advantageously used in a 5G communication system using an ultra-high frequency because it can support both a vertically polarized wave and a horizontally polarized wave.

The embodiments of the present disclosure disclosed in the specification and drawings have suggested given examples in order to easily describe the technical contents of the present disclosure and to help understanding of the present disclosure, and are not intended to limit the scope of the present disclosure. That is, it is evident to those skilled in the art to which the present disclosure pertains that other modified examples based on technical spirit of the present disclosure may be practiced. Furthermore, the embodiments may be combined and operated, if necessary. For example, a base station and a terminal may be operated in such a manner that part of embodiment 1 and part of embodiment 2, and part of embodiment 3 of the disclosure are combined.

What is claimed is:

1. An antenna module comprising:

a multi-layered layer in which a plurality of layers is stacked, a slot being formed in one side of the multi-layered layer;

a first power feeding part positioned in the slot;

at least one patch antenna spaced apart from the one side of the multi-layered layer as much as a first preset distance; and a second power feeding part electrically connected to the at least one patch antenna and positioned in the slot.

2. The antenna module of claim 1, wherein the slot is continuously extended and formed from a topmost layer of the one side of the multi-layered layer to one side of a preset layer.

3. The antenna module of claim 1, further comprising a reflector positioned within the multi-layered layer and spaced apart from the first power feeding part as much as a second preset distance.

4. The antenna module of claim 1, further comprising a first ground pad positioned in a topmost layer of the multi-layered layer, wherein the first power feeding part is electrically connected to the first ground pad.

5. The antenna module of claim 1, wherein:

the slot has a rectangle shape when viewed from a top side of the multi-layered layer, and a length of each side of the rectangle is determined based on a resonant frequency of the antenna module.

6. The antenna module of claim 5, wherein an edge of the slot is subjected to tapering processing.

7. The antenna module of claim 1, further comprising a second ground pad positioned in a topmost layer of the multi-layered layer, wherein the second power feeding part is electrically connected to the second ground pad.

* * * * *